US009068355B1

(12) United States Patent
Ksiezopolski

(10) Patent No.: US 9,068,355 B1
(45) Date of Patent: Jun. 30, 2015

(54) FLOOR COVERING TRANSITION

(71) Applicant: LTI Flexible Products, Inc., Modesto, CA (US)

(72) Inventor: Edwin E Ksiezopolski, Granger, IN (US)

(73) Assignee: LTI Flexible Products, Inc., Modesto, CA (US)

( * ) Notice: Subject to any disclaimer, the term of this patent is extended or adjusted under 35 U.S.C. 154(b) by 0 days.

(21) Appl. No.: 14/589,135

(22) Filed: Jan. 5, 2015

(51) Int. Cl.

| | |
|---|---|
| ***E04C 3/00*** | (2006.01) |
| ***E04D 1/36*** | (2006.01) |
| ***E04F 15/02*** | (2006.01) |
| ***A47G 27/04*** | (2006.01) |
| ***E04F 19/02*** | (2006.01) |

(52) U.S. Cl.
CPC ..... *E04F 15/02016* (2013.01); *A47G 27/045* (2013.01); *E04F 15/02033* (2013.01); *E04F 19/02* (2013.01)

(58) Field of Classification Search
CPC ..... E04F 15/02016; E04F 15/02033; E04F 19/02; A47G 27/045
USPC ..... 52/469, 459
See application file for complete search history.

(56) References Cited

U.S. PATENT DOCUMENTS

| | | | | |
|---|---|---|---|---|
| 6,550,205 | B2 | 4/2003 | Neuhofer, Jr. | |
| 8,813,427 | B2 * | 8/2014 | Meeks | 49/471 |
| 2003/0084634 | A1 * | 5/2003 | Stanchfield | 52/464 |
| 2005/0229517 | A1 * | 10/2005 | Gomez Insa | 52/393 |
| 2007/0283654 | A1 * | 12/2007 | Stanchfield et al. | 52/465 |
| 2008/0105372 | A1 * | 5/2008 | Neuhofer | 156/280 |
| 2008/0263992 | A1 * | 10/2008 | Plasek et al. | 52/716.8 |
| 2012/0110938 | A1 * | 5/2012 | DesJardins, Jr. | 52/309.1 |

* cited by examiner

*Primary Examiner* — Joshua J Michener
*Assistant Examiner* — Keith Minter
(74) *Attorney, Agent, or Firm* — Botkin & Hall, LLP

(57) ABSTRACT

A floor transition device is provided that allows a ramped transition between two different flooring surfaces. The transition device covers at least one exposed edge of the flooring surface. The bottom is attached to an existing flooring surface. The top snaps down to the bottom, capturing material between an upper biasing surface and a lower biasing surface. A portion of the top is flexible to allow different thicknesses of material.

17 Claims, 12 Drawing Sheets

14

78
48
52
18
84
82
44
80
20
54
62
28
88
96
74
76
36
86
34
66
60
98
64
30
38
92
32
90
50
46
94
42
10

FLOOR COVERING TRANSITION

BACKGROUND OF THE INVENTION

This present disclosure relates to carpet hold-down products and flooring transitions, particularly ones that do not have exposed fasteners and can be assembled easily. Many different types of floor transitions are available, but many have exposed fasteners, require assembly, or are difficult to install. Differing flooring thicknesses can create a need for a custom floor transition device that covers various thicknesses. An improved flooring transition device is needed.

SUMMARY OF THE INVENTION

The present disclosure describes a hold-down device that snaps together and allows a transition between two different flooring materials. The device has a mounting portion and a top portion that snap together to conceal an unfinished edge of carpet or other material. The mounting portion is attached to the existing floor and the carpet or other flooring is placed partially overlapping the mounting portion. The top portion is then pushed up against the mounting portion. This causes snaps to engage and keep the top portion and mounting portion together. The top portion has a flexible wing that allows for various thicknesses of carpet or related material while the snap is still capable of being engaged. Additionally, a two-piece transition accomplishes the same task but uses a tongue and groove instead of a living hinge.

BRIEF DESCRIPTION OF THE DRAWINGS

A preferred embodiment of this invention has been chosen wherein.

DESCRIPTION OF THE PREFERRED EMBODIMENT

Figure 1:
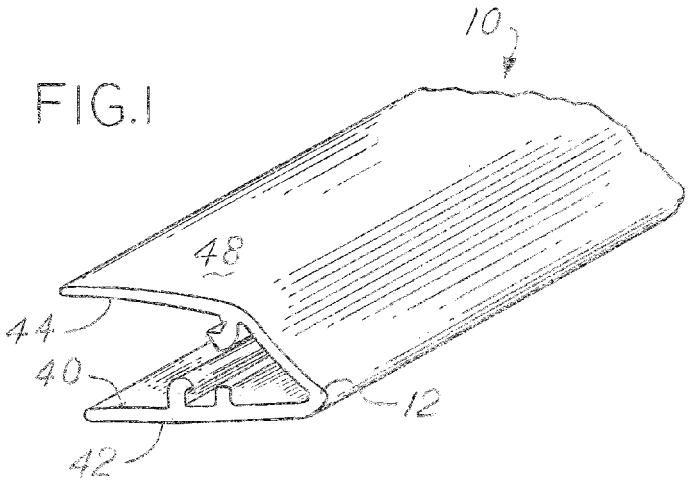
FIG. 1 is an isometric view of the single piece hold-down.
Figure 2:
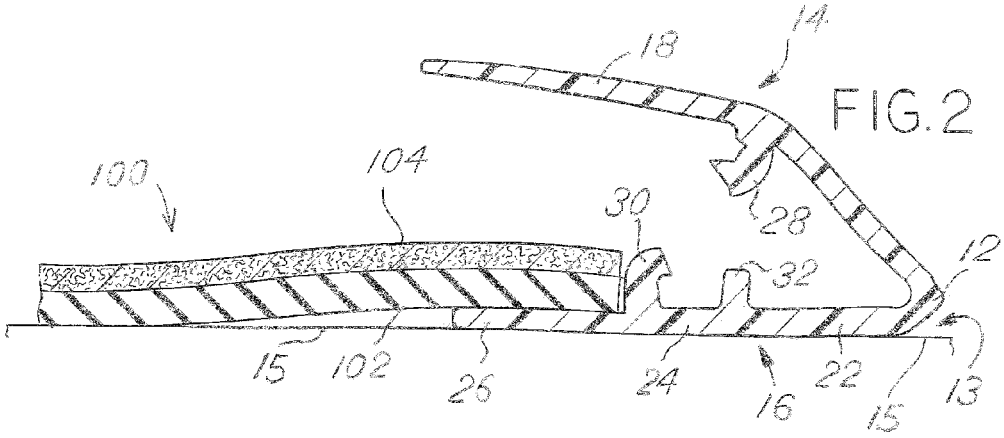
FIG. 2 is a section view of the hold-down in the unlatched position.
Figure 3:
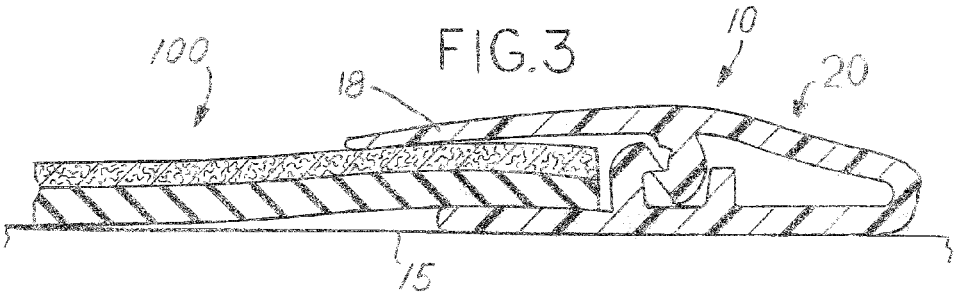
FIG. 3 is a section view of the hold-down in the latched position.

A material hold-down device 10 as shown in FIGS. 1-5 is formed from a single extrusion and has a lower portion 16, a hinge 12, and an upper portion 14. The upper portion 14 is designed to snap down to the lower portion 16 through hooks 28 and 30. The attachment of hooks 28 and 30 keep the upper portion 14 mated with the lower portion 16 to create a smooth transition between one flooring surface 15 and a material such as carpet 100 as shown in FIG. 3. The flooring is typically at a different height on one side of the device, compared to the other side. The device 10 covers up an exposed edge and prevents tripping, catching, and unraveling of the carpet 100 or other material. The upper portion 14 has one hook 28 and the lower portion 16 has one hook 30.

Figure 4:
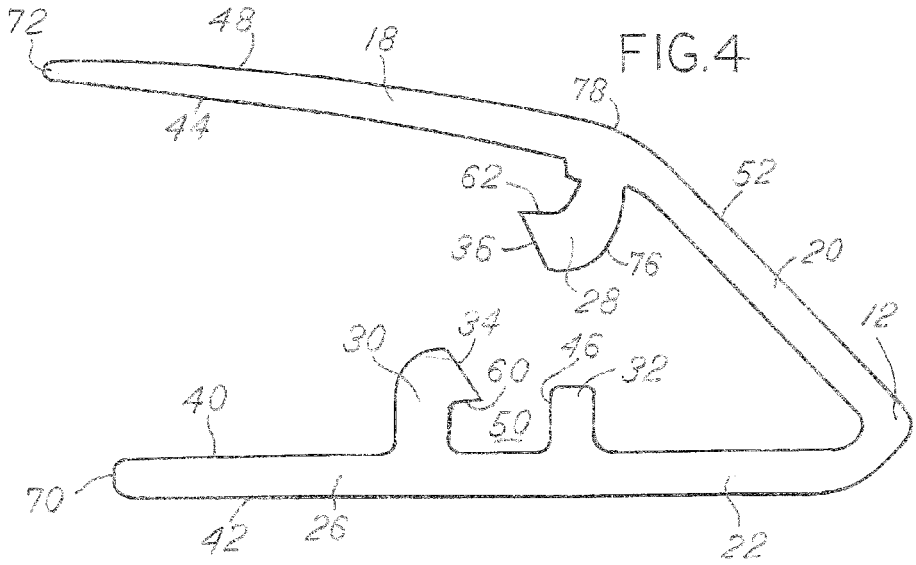
FIG. 4 is a section view of the hold-down in the unlatched position.
Figure 6:
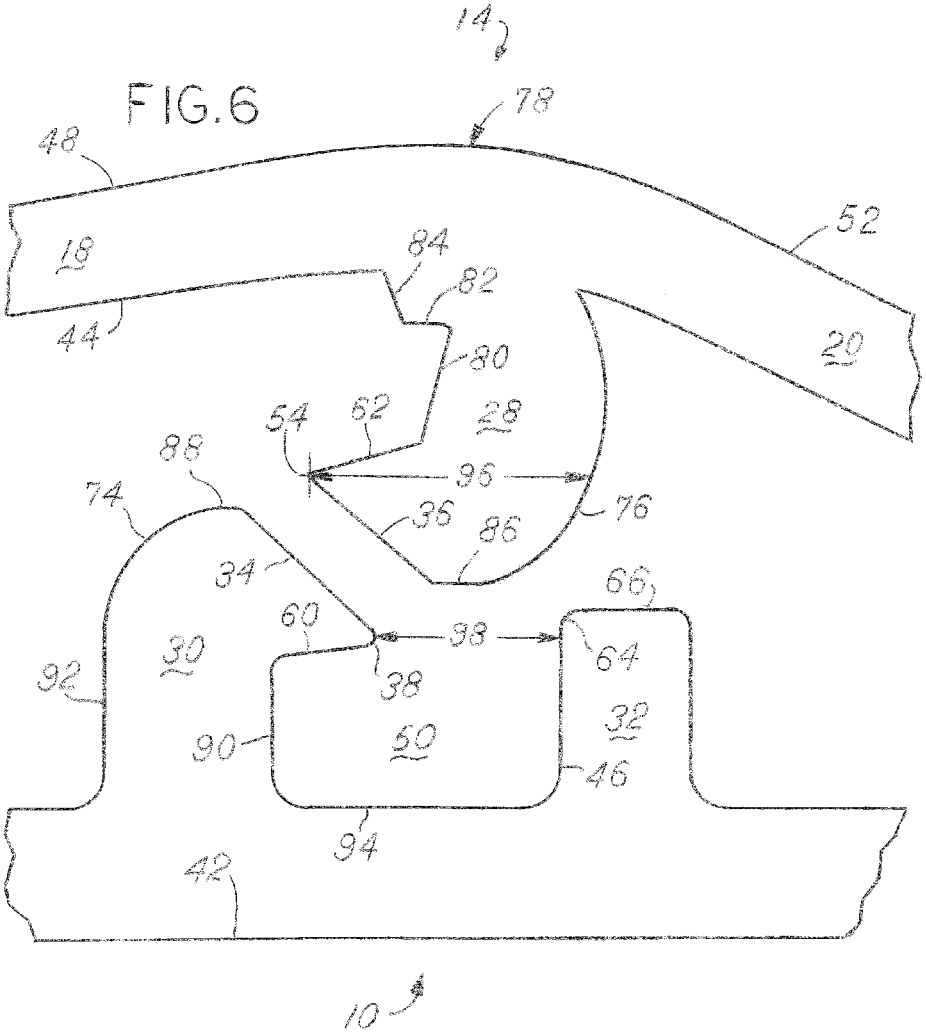
FIG. 6 is a partial view of the hold-down in FIG. 5 with the catch before engagement.

The lower portion 16 has several sections as shown in FIG. 4. There is a lower surface 42 and a gripping surface 40. The lower surface 42 is adapted to be affixed to an existing floor 15 or wall. Lower surface 42 extends from a terminal end 70 to the hinge 12. The upper surface of the lower portion between the terminal end 70 and the hinge 12 has several features. The upper surface between the terminal end 70 and a lower hook 30 is a lower gripping portion 26. The lower gripping portion 26 is made up of a portion of the lower surface 42, the terminal end 70 and a gripping surface 40. When installed with carpet 100, the gripping surface 40 is overlapped by the lower surface 102 of carpet 100 when installed as shown in FIGS. 2 and 3. The gripping surface 40 can be smooth as shown or could be textured to provide additional resistance to prevent the carpet 100 that is being clamped from being easily pulled out. Adjacent to the gripping surface 40 is a lower hook 30 that protrudes upward from the upper surface. The lower hook 30 has an upstanding portion made from an upstanding surface 92 FIG. 6 that intersects the gripping surface 40 and another upstanding surface 90 that faces a stop 32. At the top of the offset portion is a hook portion. The hook portion has a curved surface 74 that starts at the top of upstanding surface 92 and curves to intersect a sliding surface 34. Optionally, there is a flat 88 between the curved surface 74 and the sliding surface 34. The sliding surface 34 is shown angled downward towards an upper surface 94 FIG. 6 of channel 50 and overhangs upstanding surface 90. It is possible that sliding surface 34 is curved. Located between upstanding surface 90 and sliding surface 34 is catch surface 60. A hook tip 38 is where sliding surface 34 and catch surface 60 intersect. The catch surface 60 overhangs a portion of upper surface 94. A stop 32 is spaced apart from the lower hook 30 as shown in FIG. 6. Stop 32 resides between the hinge 12 and the lower hook 30. A portion of the upper surface 94 extends between upstanding surface 90 and an upstanding wall 46 of stop 32. Where wall 46 of the stop meets a top surface 66, a corner 64 is made. As is shown in FIG. 6, the overhang portion protrudes inwardly towards stop 32 to form an opening 98 between the hook tip 38 and the corner 64. The opening 98 distance is when stop 32 and hook 30 are in a resting position as shown in FIG. 2. Between stop 32 and hinge 12 is an attachment portion 22 where the device 10 can be affixed to the flooring surface 15. The attachment portion 22 allows staples, screws, nails or related fasteners to be driven through the lower portion to a flooring surface that is in contact with the lower surface 42.

Figure 9:
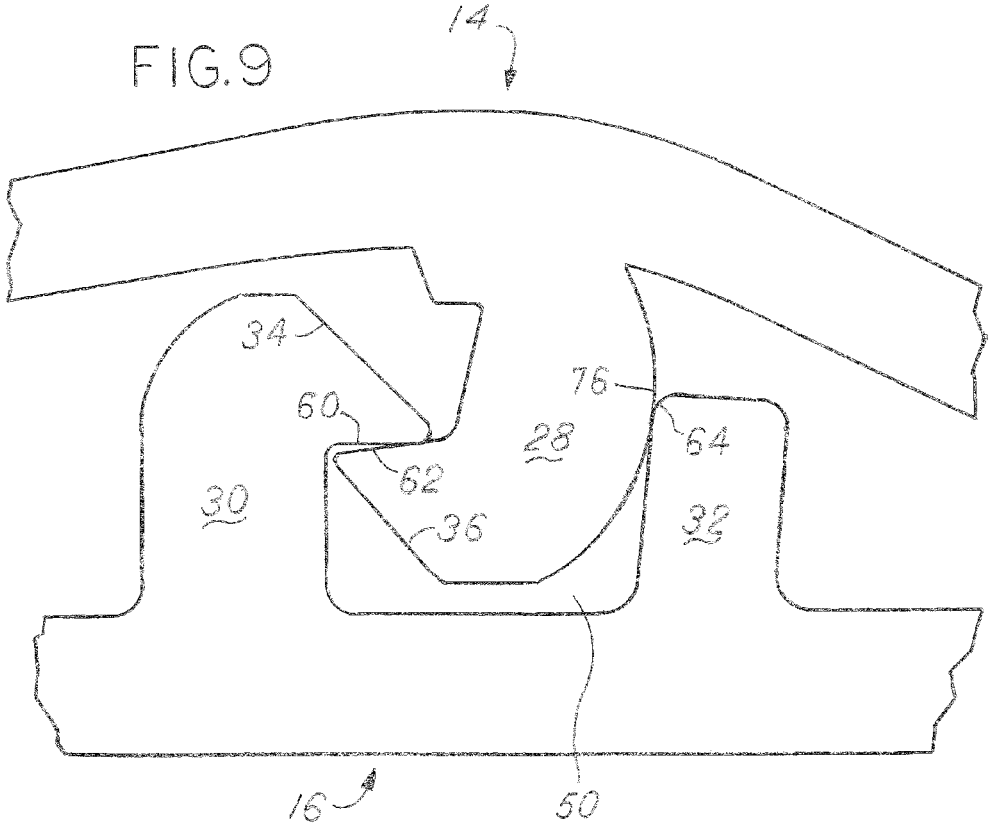
FIG. 9 is a partial view of the hold-down in FIG. 5 with the catch completely engaged.

The upper portion 14 is made up of several portions as shown in FIG. 4. The upper surfaces 48, 52, and 78 can be decorative and are designed to handle foot and other traffic. Upper surface 48 is the upper surface of a gripping portion 18 FIG. 5. The upper gripping portion 18 extends between a terminal end 72 and an upper hook 28. The lower surface between a terminal end 72 and the upper hook 28 is an upper gripping surface 44. The gripping surface 44 can either be smooth or textured to prevent movement between the device 10 and the material that is being clamped. The upper surface 48 and upper gripping surface 44 become closer towards the terminal end 72, making the gripping portion 18 tapered near the terminal end. This allows the resilient material to more evenly distribute any force applied between the upper hook and the terminal end. The gripping portion 18 also allows any distortion created by a carpet 100 to be distributed. By having the upper portion 14 thinnest near the terminal end, the step between the top surface of the carpet 104 to the device 10 is minimized. The lower surface 42 of the gripping portion is designed to maintain partial contact with a material such as carpet 100, specifically upper surface 104 once the device 10 is completely snapped together as shown in FIG. 9. Since different brands and styles of carpet 100 can vary in thickness (the distance between lower surface 102 and upper surface 104), the thinner section is flexible and distorts as necessary when catch surface 62 is engaged with catch surface 60. This distortion can be seen by comparing the thinner section in FIG. 2 to FIG. 3. Adjacent to the upper gripping surface 44 is an upper hook 28 that protrudes downwardly from the upper portion. The upper hook 28 has a standoff portion made from walls 84, 82, 80 FIG. 6 and a biasing surface 76. Walls 82 and 84 are optional and are provided in this embodiment to reduce the stress that would occur between upper gripping surface 44, upper hook 28, and wall 80. Upper hook 28 includes a hook portion. Catch surface 62 protrudes outwardly from surfaces 80, 82, and 84, creating an offset portion. The catch surface 62 is parallel to the upper gripping surface 44. Located between biasing surface 76 and catch surface 62 is a sliding surface 36. Sliding surface 36 is shown as a flat surface, but it does not have to be flat. Optionally, a flat surface is located between biasing surface 76 and sliding surface 36. The upper hook 28 has a distance 96 that is measured by the distance between the hook point 54 and a point located opposite the hook point along biasing surface 76. The width 96 is greater than the opening 98. The upper portion 14 near the terminal end 72 is thinner. A ramp surface 52 is the upper surface of a ramp portion 20 and extends from the hinge 12. The crown surface 78 FIGS. 4 and 6 is located between the ramp surface 52 and the upper surface 48. The crowned surface 78 is curved.

The hinge 12 attaches the lower portion 16 to the upper portion 14. The hinge 12 also locates the upper hook 28 relative to the lower hook 30 and stop 32. The hinge 12 is flexible and allows the upper portion 14 and lower portion 16 to move between the natural position of the parts as shown in FIG. 2 and the attached position of the parts as shown in FIG. 3. The hinge 12 has a notch 13 FIG. 2 which allows the upper portion 14 clearance as the upper portion 14 bends away from the lower portion 16. As the upper portion 14 is pivoted about the hinge 12 to be moved closer to the lower portion 16, the hinge 12 positions the upper hook 28 between the lower hook 30 and the stop 32.

Figure 5:
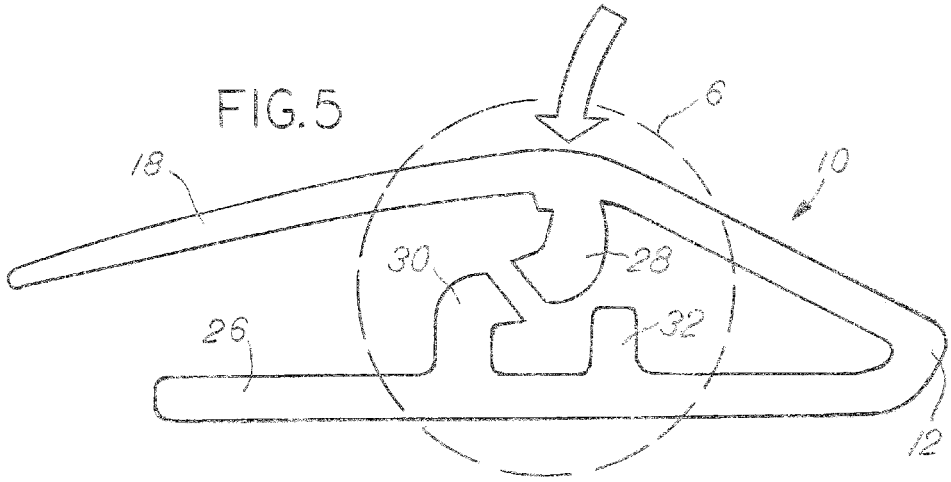
FIG. 5 is a section view of the hold-down as the upper portion is moved towards the lower portion.
Figure 7:
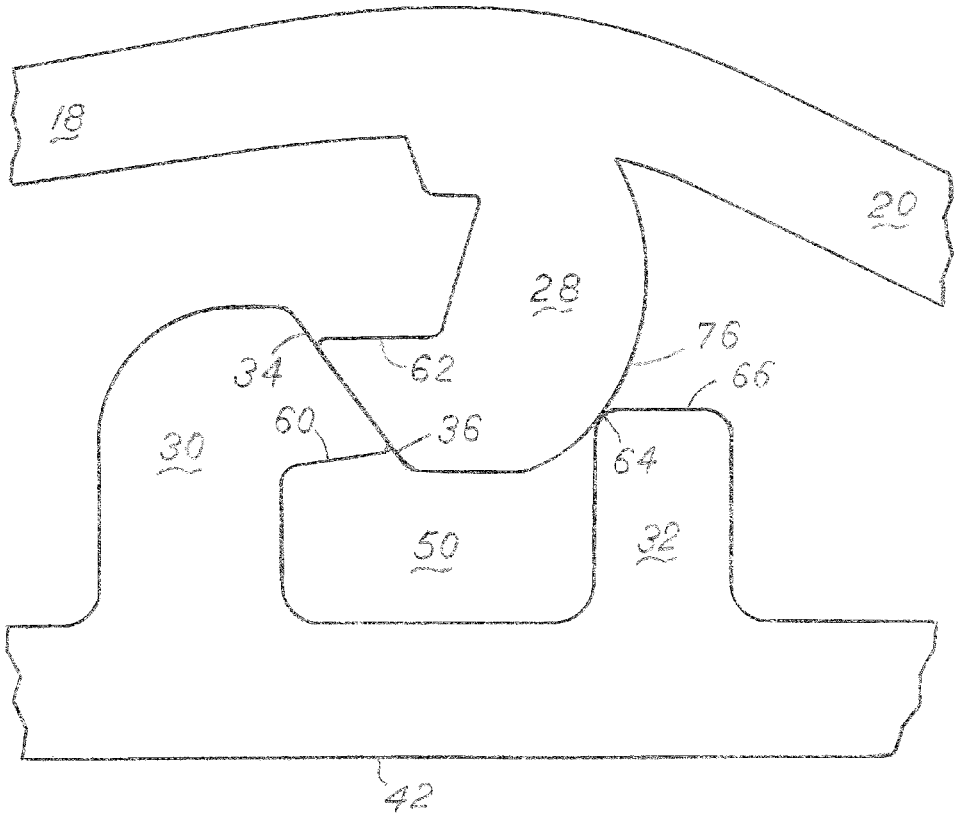
FIG. 7 is a partial view of the hold-down in FIG. 5 with the catch partially engaged.
Figure 8:
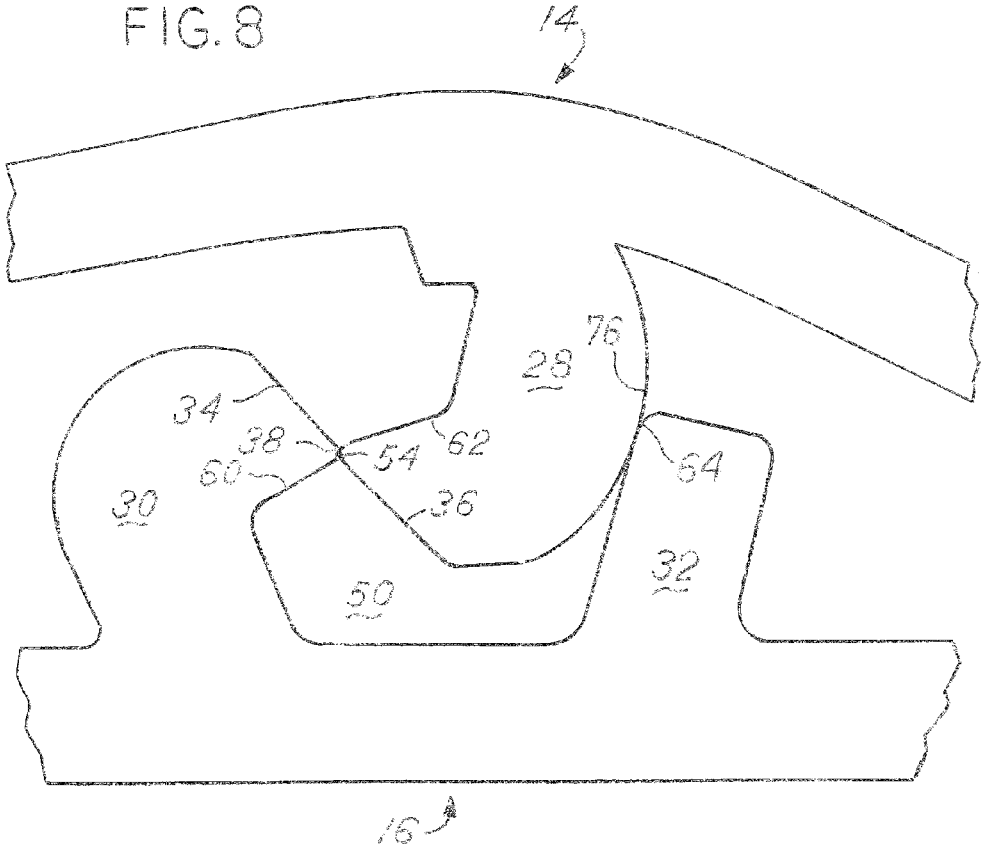
FIG. 8 is a partial view of the hold-down in FIG. 5 with the catch mostly engaged.

The movement of the device between what is shown in FIG. 2 and FIG. 3 are shown in FIGS. 4-9. For the purposes of clarity, the carpet 100 is not shown in FIGS. 4-9. FIG. 4 shows the device 10 in a natural resting position. The upper hook 28 and lower hook 30 are spaced apart when the device 10 is in the resting position. On the upper portion 14, the crowned surface 78 is located opposite the upper hook 28. In order to fix the upper portion 14 to the lower portion 16, the user applies compressive force between the crowned portion and the lower portion, moving the upper portion 14 closer to the lower portion 16 as shown in FIG. 5. Moving the upper portion 14 closer to the lower portion 16 causes the upper hook 28 and lower hook 30 to make contact, specifically sliding surface 34 contacts sliding surface 36. Additionally, the biasing surface 76 begins to make contact with corner 64 on the stop 32 as is shown in FIG. 7. Further pressure on the crowned surface 78 causes the stop 32 to begin to distort along with the lower hook 30 as shown in FIG. 8. The original distance of the opening area 98 as shown in FIG. 6 begins to increase to the distance 96 of the upper hook 28 while sliding surfaces 34 and 36 slide relative to each other while the upper portion 14 moves closer to the lower portion 16. Biasing surface 76 also slides along the corner 64. The corner 64 and sliding surface 34 exert counteracting lateral pressure on the upper hook 28, preventing excessive pressure on the hinge 12. The distortion of the lower hook 30 and stop 32 is maximized where the two hook tips 38, 54 meet as shown in FIG. 8. Once the upper portion 14 is pressed down far enough for the hook tip 54 to pass hook tip 38, most or all of the distortion of stop 32 and lower hook 30 are removed and catch surface 60 and 62 overlap as shown in FIG. 9. At this point, the offset portion of the upper hook 28 resides in the channel 50. Based on the thickness of the carpet 100, the upper gripping portion 18 flexes and becomes more parallel to the ramp portion 20 as shown in FIG. 3.

To attach the device to the flooring surface 15, the upper portion 14 is rotated about the hinge 12 such that the upper portion 14 is nearly perpendicular to the lower portion 16. This reveals the attachment portion 22 for the user to nail, staple, screw or otherwise affix the device 10 to the flooring surface 15. The user places carpet 100 that overlays the lower gripping portion 26. The user then takes the top portion 14 and hinges it down, causing the upper hook 28 to contact the lower hook 30 and stop 32. Pressure is applied on the crowned surface 78 in the form of a mallet, roller, or foot to move the upper hook 28 into the channel 50, firmly securing the upper portion 14 to the lower portion 16.

Figure 10:
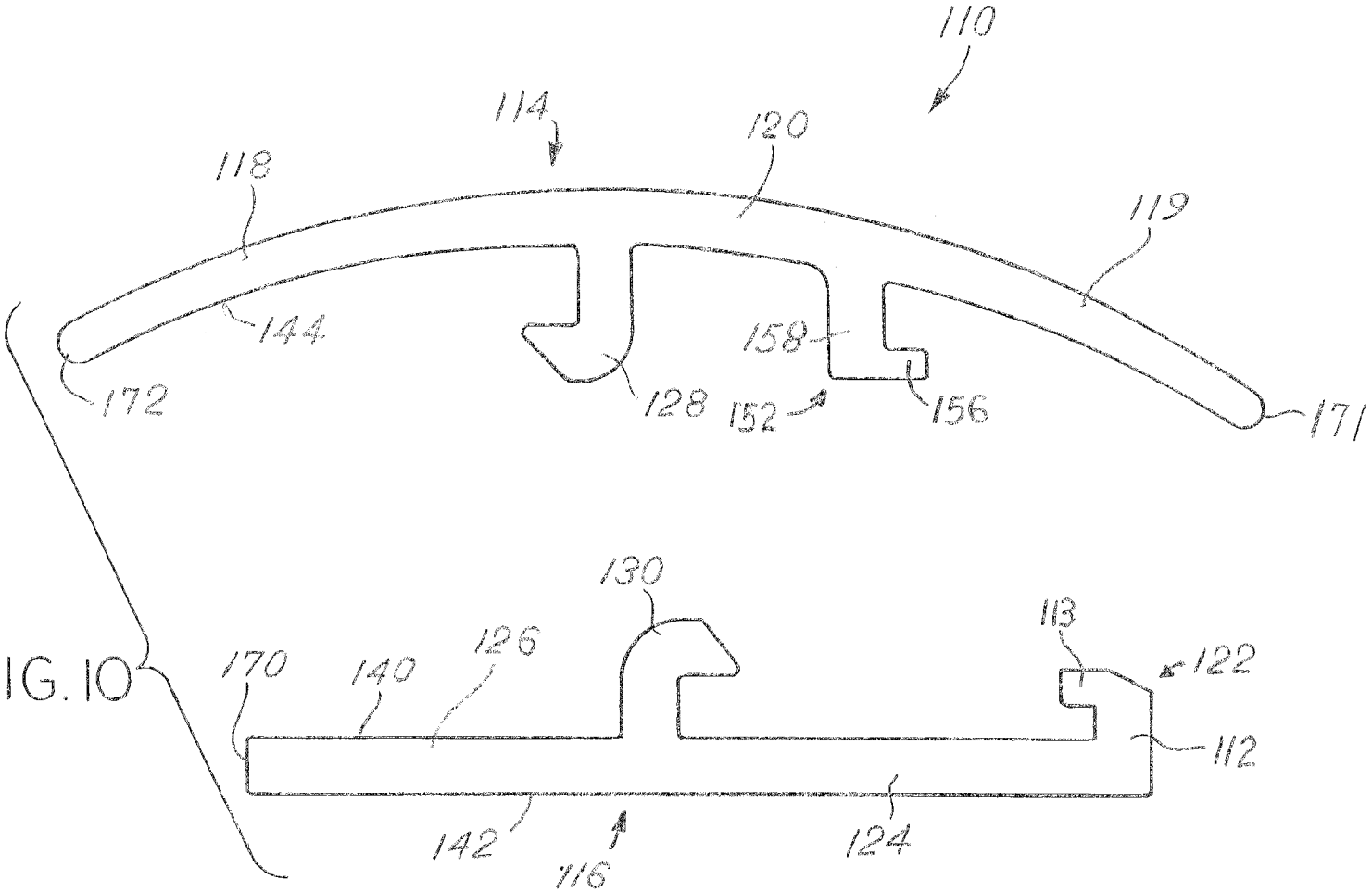
FIG. 10 is a section view of an alternate embodiment.
Figure 11:
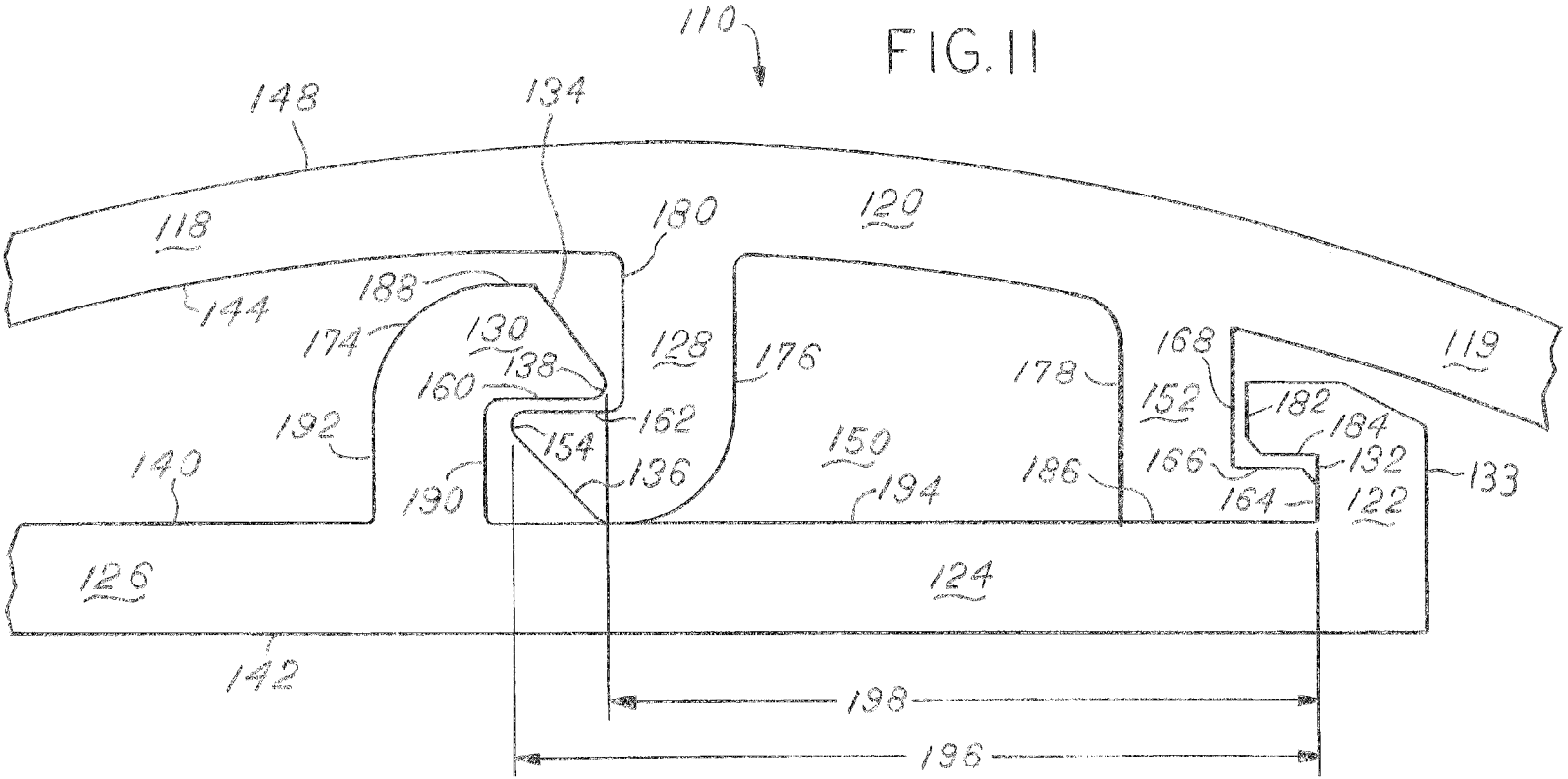
FIG. 11 is a partial section view of the embodiment of FIG. 10.

In an alternate embodiment as shown in FIGS. 10 and 11, an upper 114 and a lower 116 are separate. The hinge area is the where the tongue 124 meets the groove 122 as shown in FIG. 10. This embodiment has an upper hook 128 on the upper 114 and a lower hook 130 on the lower 116. As with the single piece embodiment, only one set of hooks used to attach the upper to the lower.

Figure 15:
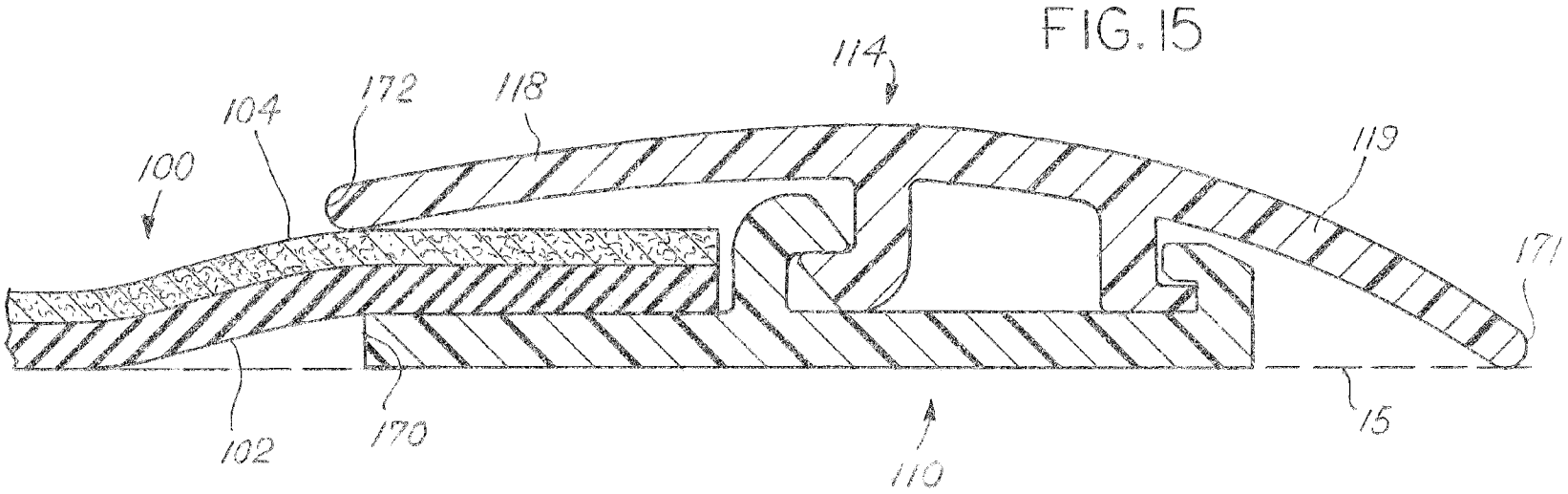
FIG. 15 is a section view of the embodiment in FIG. 10 with the catch completely engaged.

The lower 116 has several sections as shown in FIGS. 10 and 11 including a lower surface 142 and an upper surface. The lower surface 142 is adapted to be affixed to an existing floor 15 or wall. Lower surface 142 extends from a terminal end 170 to a groove 122. The upper surface of the lower between the terminal end 170 and the groove 122 has several features. The upper surface between the terminal end 170 and a lower hook 130 is a lower gripping portion 126. The lower gripping portion 126 is made up of a portion of the lower surface 142, the terminal end 170 and a gripping surface 140. When installed with carpet 100, the gripping surface 140 overlaps the lower surface 102 of material when installed as shown in FIG. 15. The gripping surface 140 can be smooth as shown or could be textured to provide additional resistance to prevent the material that is being clamped from being easily pulled out. Adjacent to the gripping surface 140 is a lower hook 130 that protrudes upward from the upper surface. The lower hook 130 has an upstanding portion made from an upstanding surface 192 FIG. 11 that faces the gripping surface 140 and another upstanding surface 190 that faces the groove 122. At the top of the upstanding portion is a hook portion. The hook portion has a curved surface 174 that starts at the top of upstanding surface 192 and curves to meet a sliding surface 134. Optionally, there is a flat 188 between the curved surface 174 and the sliding surface 134. The sliding surface 134 is shown angled downward towards an upper surface 194 of channel 150 and overhangs upstanding surface 190. It is possible that sliding surface 134 is curved. Located between upstanding surface 190 and sliding surface 134 is catch surface 160. A hook tip 138 is where sliding surface 134 and catch surface 160 intersect. The catch surface 160 is parallel to and overhangs a part of upper surface 194.

The groove 122 is an upstanding wall portion and catch portion and is spaced apart from the lower hook 130 as shown in FIG. 11. It has an upstanding wall portion 112 and an offset portion 113. The groove 122 is located opposite the terminal end 170. The wall portion is made up of inner surface 132 and outer surface 133. The outer surface 133 forms a second terminal end. The inner surface 132 extends upwardly from upper surface 194 and faces upstanding surface 190. The offset portion 113 spaced apart from the upper surface 194 and extends toward hook tip 138 with a surface 184 that is parallel to upper surface 194. Surface 184 forms a portion of the groove 122, along with inside surface 132. Another surface 182 extends perpendicular from surface 184 to form the rest of the groove. As is shown in FIG. 11, the overhang portion of the lower hook protrudes inwardly towards groove 122 to form an opening 198 between the hook tip 138 and the inner surface 132. The opening 198 distance is when the groove 122 and hook 130 are in a resting position. Between the lower hook 130 and groove 122 is an attachment portion 124 where the device 10 can be affixed to a flooring surface 15. The attachment portion 124 allows staples, screws, nails or related fasteners to be driven through the lower portion to a flooring surface 15 that is in contact with the lower surface 142. A channel is formed by the attachment portion 124, upstanding surface 190 and inside surface 132. The groove 122 faces the lower hook 130 as shown in FIG. 11.

The upper 114 is made up of several portions as shown in FIG. 10. The upper surface 148 as shown in FIG. 11 can be decorative and is designed to handle foot and other traffic. Upper surface 148 is shown as a continuous arc but can have other forms. The gripping portion 118 extends between a terminal end 172 and an upper hook 128. A ramp portion 119 extends from a terminal end 171 and a tongue 152. The tongue 152 has an upstanding wall portion 158 and an overhang portion 156. The lower surface between a terminal end 172 and the upper hook 128 is an upper gripping surface 144. The gripping surface 144 can either be smooth or textured to prevent movement between the device 110 and the material that is being clamped. The lower surface 144 of the upper section is designed to maintain biased contact with a material such as carpet 100, specifically upper surface 104 once the device 10 is completely snapped together as shown in FIG. 11. Since different brands and styles of carpet 100 can vary in thickness (the distance between lower surface 102 and upper surface 104), the gripping portion 118 is flexible and distorts as necessary when catch surface 160 is engaged with catch surface 162 as shown in FIG. 15. Adjacent to the upper gripping surface 144 is an upper hook 128 that protrudes downwardly from the upper 114. The upper hook 128 has a standoff portion made from upstanding walls 180 and 176 and a hook portion. Catch surface 162 protrudes outwardly from surface 180, creating an offset portion. The catch surface 162 is parallel to the portion of the upper gripping surface 144 that is nearest the upper hook 128. Located between surface 176 and catch surface 162 is a sliding surface 136. Sliding surface 136 is shown as a flat surface, but can have other shapes. Optionally, a flat surface can be located between surface 176 and sliding surface 136 to provide support to the upper hook 128 when heavy foot traffic is present. The upper portion 114 includes a tongue 152 with a bottom surface 186, a tongue tip 164, upstanding walls 168, 178, and a surface 166. A wall 178 extends outward from the lower surface of the upper portion, where it intersects a bottom surface 186. Bottom surface 186 is parallel to catch surface 162. Bottom surface 186 extends to intersect the tongue tip 164. The tongue tip 164 is parallel to wall 178. Tongue tip 164 intersects the upper surface 166 of the tongue. The upper surface 166 extends toward wall 178 and is parallel to the bottom surface 186. Upper surface 166 then intersects another upstanding wall 168, which is parallel to wall 178. Upstanding wall 168 then intersects the lower surface of the upper portion. The upper 114 has a distance 196 that is measured by the distance between the tongue tip 164 and the hook point 154. The width 196 is greater than the opening 198. The tongue 152 faces away from the upper hook 128 as shown in FIG. 11.

Figure 12:
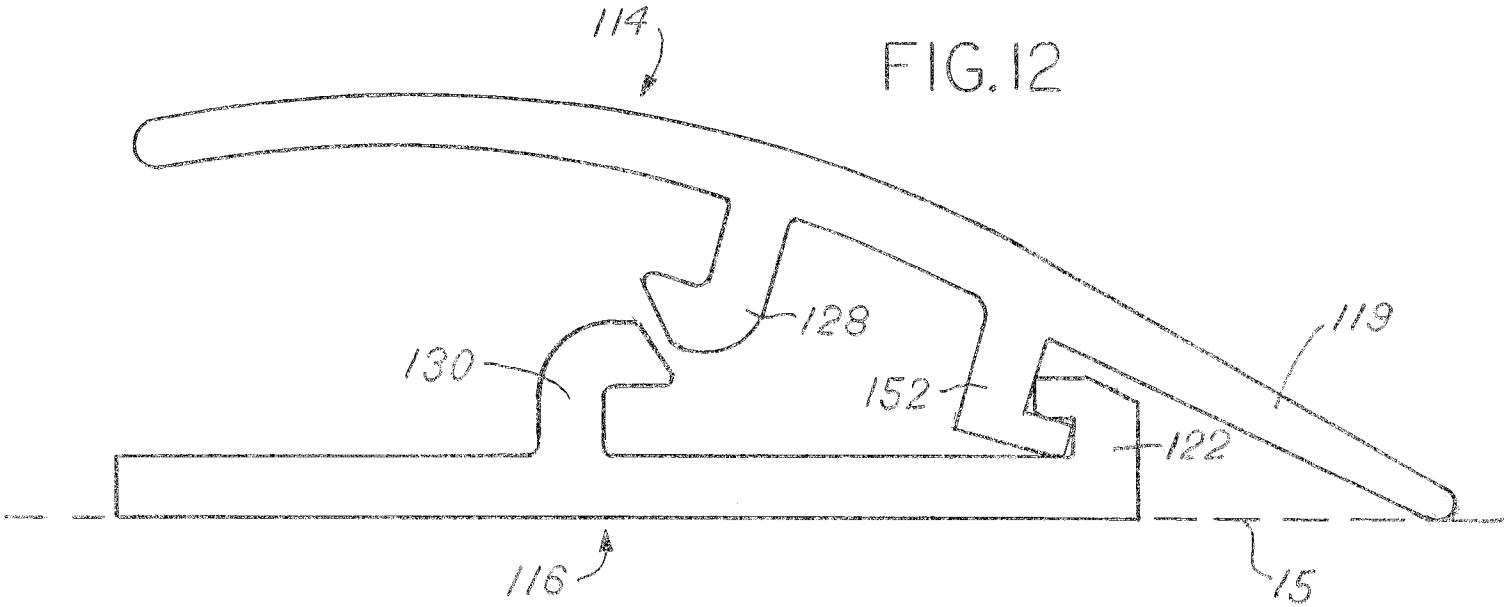
FIG. 12 is a section view of the embodiment in FIG. 10 with the upper partially engaged.
Figure 13:
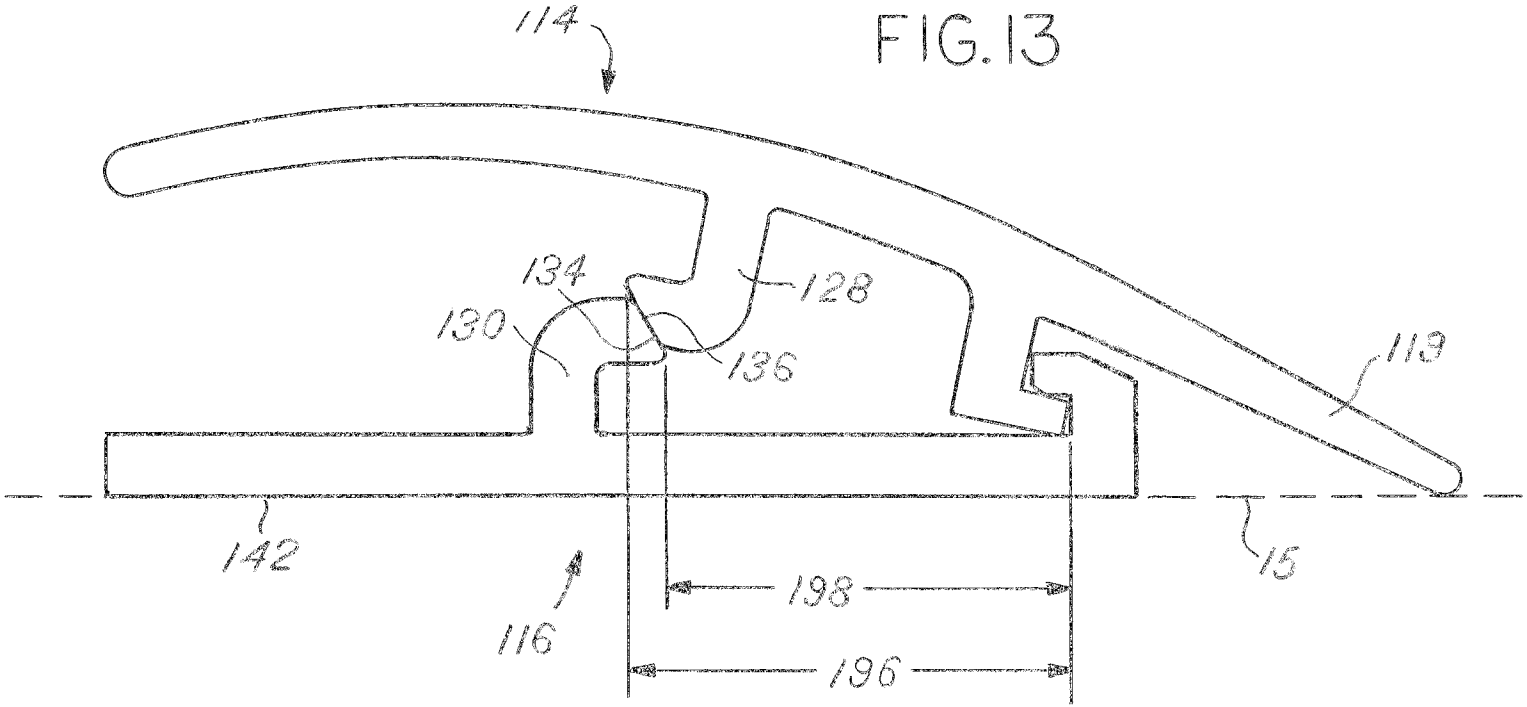
FIG. 13 is a section view of the embodiment in FIG. 10 with the catch partially engaged.
Figure 14:
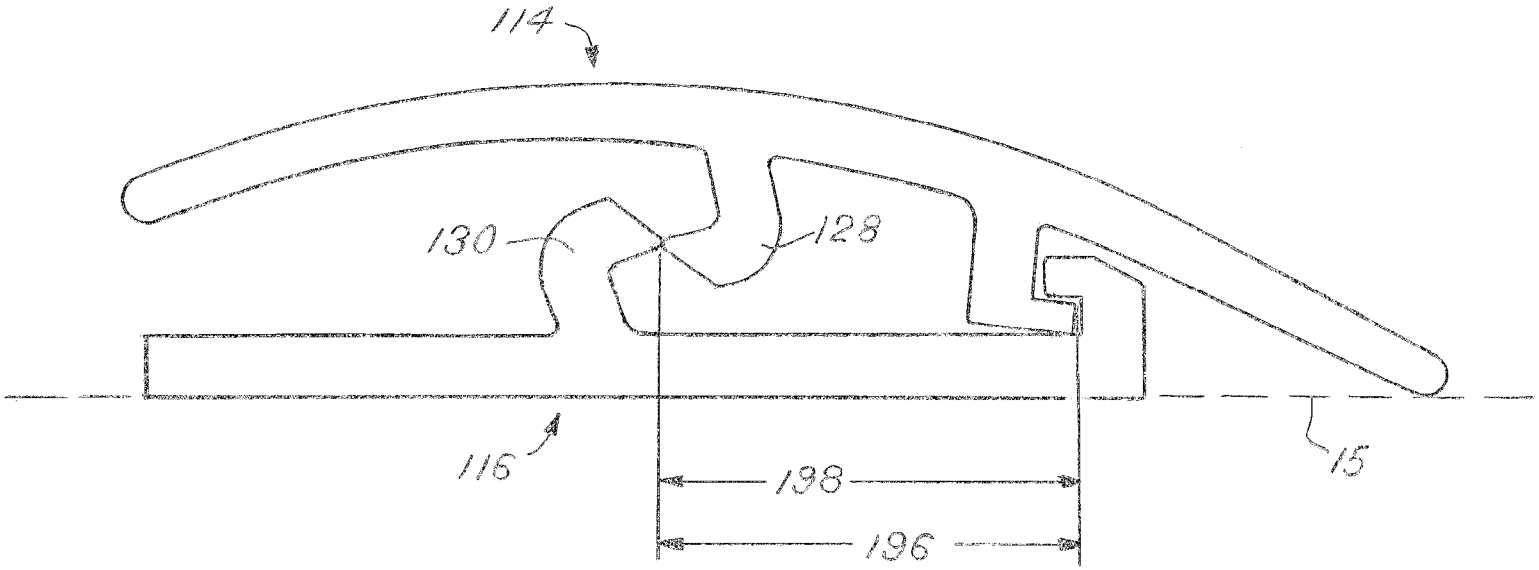
FIG. 14 is a section view of the embodiment in FIG. 10 with the catch mostly engaged.

The movement of the device 110 between what is shown in FIG. 10 and FIG. 15 are shown in FIGS. 12-14. For the purposes of clarity, the carpet 100 is not shown in FIGS. 10-14, but it is expected to be present and partially overlay the lower gripping surface before the upper 114 is brought into position as shown in FIG. 15. FIG. 10 shows the device 110 as separate parts where the upper hook 128 and the lower hook 130 are separated along with tongue 152 and groove 122. In order to fix the upper 114 to the lower 116, the user first puts the tongue 152 into the groove 122. This puts a portion of the tongue tip 164 in contact with inner surface 132 as shown in FIG. 12. At the same time, the ramp portion 119 temporarily distorts to allow the tongue to reach the groove. This distortion is visible in FIGS. 12 and 13. The upper hook 128 and lower hook 130 are spaced apart when the device 110 is positioned as it is shown in FIG. 12. The user then begins to pivot the upper 114 about the inner surface 132 in order to bring the top hook 128 in contact with lower hook 130. This places sliding surface 134 in contact with sliding surface 136. The user then applies compressive force between the upper and the lower, moving the upper 114 closer to the lower 116. As the upper 114 is brought closer to the lower 116, the sliding surface 134 of the lower hook 130 make sliding contact with sliding surface 136 of the upper hook 128. Further movement of the upper 114 to the lower 116 causes the lower hook 130 to start to distort as shown in FIG. 14. The original distance of the opening 198 as shown in FIG. 11 begins to increase. At the same time, the distance 196 decreases while the lower hook distorts. While sliding surfaces 134 and 136 slide relative to each other, the upper 114 moves closer to the lower 116. The distortion of the lower hook 130 and upper hook 128 is maximized where the two hook tips meet as shown in FIG. 14. When the two hook tips meet distance 196 is equal to distance 198. Once the upper 114 is pressed down far enough for the hook tip 154 to pass hook tip 138, most or all of the distortion of lower hook 130 and upper hook 128 are removed and catch surfaces 160 and 162 are in overlapping contact as shown in FIG. 11. Additionally, the distortion of the ramp portion 119 is reduced or eliminated. At this point, the offset portion of the upper hook resides in the channel 150. Based on the thickness of the carpet 100, the upper gripping portion 118 flexes and becomes more parallel to the ramp portion 119. Because the terminal ends 171, 172 are being biased upward, the section 120 may be flexed. The section 120 between the upper hook 128 and the tongue 152 flexes as the upper gripping portion 118 flexes upward, thereby causing the upper hook tip 154 and tongue tip 164 to spread apart, creating a firmer engagement of the upper 114 to the lower 116.

To install the two piece embodiment 110, the user first attaches the lower 116 to an existing floor 15. The carpet 100 is then moved to where a portion of the lower surface 102 overlies a portion of the lower gripping portion 126 on the gripping surface 140. Next, the upper 114 is brought into contact with the lower 116, specifically the tongue 152 (as shown in FIGS. 11 and 12) contacts the groove 122. The user then presses down on the upper surface 148 just above the tongue 152 to bend the ramp portion 119 sufficiently, allowing the tongue 152 to enter the groove 122. This brings tongue tip 164 into contact with the inside surface 132. The user then pivots the upper 114 downward towards the lower 116 to bring upper hook 128 into contact with the lower hook 130. Sliding surface 134 meets sliding surface 136, causing the inner surface 132 to make biased contact with tongue tip 164. Lastly, the user applies sufficient force to move the upper hook 128 past the lower hook 130 and into the channel. As installed, the upper hook tip 128 and the tongue 152 face away from each other.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A floor transition device adapted for affixing to a substantially flat surface and forming a transition between said flat surface and a material overlaying said flat surface, said device comprising:

a lower portion connected to an upper portion with a hinge, said lower portion having an upper surface and an opposite lower surface, said lower portion ending at a lower terminal end, said hinge located at an opposite end of said terminal end, said lower portion ending at said hinge, and said lower portion having a lower gripping portion being adjacent to said lower terminal end and extending toward said hinge;

a lower hook extending from said upper surface of said lower portion between said lower terminal end and said hinge, said lower hook having an upstanding portion including opposing upstanding surfaces that define a thickness of said upstanding portion, a catch surface extending outwardly of one of said upstanding surfaces substantially parallel to said upper surface of said lower portion, said lower hook including a sliding surface intersecting said catch surface at an acute angle to form a lower hook tip offset from said one upstanding surface of said upstanding portion;

a stop extending upwardly from said upper surface of said lower portion between said lower terminal end and said hinge and being opposite and adjacent to said lower hook tip, said stop having an inner surface facing said lower hook tip, said lower hook and said stop defining a channel located between said inner surface of said stop and said one upstanding portion of said hook, said channel including an opening having a first distance defined by a distance between said lower hook tip and said inner surface of said stop, and a second distance defined by a distance between said one upstanding surface and said inner surface of said stop, said second distance being larger than said first distance;

said upper portion having a lower surface, an upper terminal end located oppositely of said hinge, and an upper gripping portion being adjacent to said upper terminal end and extending toward said hinge;

an upper hook extending from said lower surface of said upper portion between said upper terminal end and said hinge, said upper hook having an upstanding portion including upstanding surfaces to define a thickness of said upstanding portion, a catch surface extending outwardly of one of said upstanding surfaces substantially parallel to said lower surface of said upper portion, said upper hook including a sliding surface intersecting said catch surface at an acute angle to form an upper hook tip offset from said one upstanding surface;

said hinge connecting said upper portion and said lower portion and facilitating movement of said upper portion with respect to said lower portion between an open position and a closed position, said open position corresponding to said upper and lower hooks being separated from each other with said gripping portions located at a relatively far distance and said closed position being where said gripping portions are relatively near each other and said upper and lower hooks interlock with said catch surfaces of said upper and lower hooks being in biased contact, movement between said open position to said closed position causing said sliding surfaces to slide against each other so that said first distance increases to allow said upper hook to be inserted between said lower hook and said stop; and a portion of said upper gripping surface and said lower gripping surface adapted for biased contact with a portion of said material when said catch surfaces of said upper and lower hook are in contact.

2. The floor transition device of claim 1, said upper hook tip faces said terminal end of said upper portion, said other upstanding surface of said lower hook adapted to abut an exposed edge of said material.

3. The floor transition device of claim 2, said device formed from a resilient material.

4. The floor transition device of claim 1, said gripping portion of said upper portion being thinner nearest said terminal end.

5. The floor transition device of claim 1, said one upstanding surface on said lower hook corresponding to an inner surface on said upstanding portion, said channel having a second distance defined by said inner surface of said upstanding portion of said lower hook and said inner surface of said stop.

6. The floor transition device of claim 1, said upper hook having a biasing surface located opposite said sliding surface of said upper hook, said biasing surface and said sliding surface being narrower across than said upper hook having a third distance defined by a distance between said upper hook tip and a point along said biasing surface substantially opposite said upper hook tip, said second distance greater than said first distance and smaller than said second distance.

7. The floor transition device of claim 1, said upper hook is located intermediate said lower hook and said stop when said upper portion is moved into contact with said lower portion.

8. A floor transition device for affixing to a substantially flat surface and forming a transition between said flat surface and a material overlying said flat surface, said device comprising:

a lower having an upper surface, a lower terminal end, a groove tab opposite said lower terminal end, and a lower gripping portion being adjacent to said lower terminal end and extending toward said groove tab;

a lower hook extending from said upper surface of said lower between said lower terminal end and said groove tab, said lower hook having an upstanding portion including opposing upstanding surfaces that define a thickness of said upstanding portion, a catch surface extending outwardly of one of said upstanding surfaces substantially parallel to said upper surface of said lower, said lower hook including a sliding surface intersecting said catch surface to form a lower hook tip offset from said one upstanding surface of said upstanding portion, said one upstanding surface corresponding to an inner surface on said upstanding portion;

said groove tab being generally L-shaped having an upstanding portion extending upward from said upper surface of said lower having an inner and outer surface, said inner surface facing said hook tip and said outer surface located opposite thereof, said upstanding portion of said groove tab terminating in an offset portion facing said lower hook, said offset portion having an upper surface and a lower surface being substantially parallel to said upper surface of said lower, said lower hook and said groove tab defining a groove located therebetween, an opening defined by said hook tip and a terminal end surface of said offset portion, said opening leading into said groove and being narrower than a distance between said inner surface of said L-shaped tab and said one upstanding surface of said lower hook;

an upper having a first and second terminal end and an upper gripping portion, said upper gripping portion being adjacent to said first terminal end;

an upper hook extending from a lower surface of said upper between said first and second terminal end, said upper hook having an upstanding portion including opposing upstanding surfaces that define a thickness of said upstanding portion, a catch surface extending outwardly of one of said upstanding surfaces substantially perpendicular thereto, said upper hook including a sliding surface intersecting said catch surface at an acute angle to form an upper hook tip offset from said one upstanding surface of said upstanding portion, said one upstanding surface corresponding to an outer surface on said upstanding portion;

said upper having a second L-shaped tongue tab extending downward from said lower surface of said upper including an upstanding portion having an inner and outer surface, said outer surface facing away from said upper hook, said upstanding portion of said tongue tab having an offset portion having an upper surface and a lower surface and terminating in a tab tip, said upper surface of said offset portion being substantially perpendicular to said outer surface of said tongue tab, said upper hook and said second tongue tab defining a tongue, said tongue having a first distance defined by said hook tip and said tab tip, said tongue having a second distance between said outer surface of said upstanding portion of said upper hook and said outer surface of said upstanding portion of said second tongue tab, said first distance being larger than said opening on said lower;

a portion of said upper gripping surface and said lower gripping surface in biased contact with a portion of said material when a portion of said catch surface of said upper and lower hooks are in contact.

9. The floor transition device of claim 8, said second terminal end is in biased contact with said flat surface when said catch surface of said lower hook is in biased contact with said catch surface of said upper hook and said tongue is in said groove.

10. The floor transition device of claim 9, said outside surface of said groove defines a second lower terminal end opposite said lower terminal end.

11. The floor transition device of claim 10, said upper having only one hook, said lower having only one hook.

12. The floor transition device of claim 8, said catch surface of said upper hook is in biased contact with said catch surface of said lower hook when said upper portion is in a latched position with respect to said lower portion.

13. The floor transition device of claim 12, said hook tip of said upper hook faces said terminal end of said upper.

14. The floor transition device of claim 13, said gripping portion of said upper being thinner nearest said terminal end.

15. The floor transition device of claim 8, said first surface adapted to abut an exposed edge of said material.

16. The floor transition device of claim 15, said lower hook tip facing said groove, said upper hook tip facing said first terminal end, said tongue facing said second terminal end.

17. The floor transition device of claim 8, said gripping surface is located outside said tongue and said groove.

* * * * *